US006939439B1

(12) United States Patent
Paakki et al.

(10) Patent No.: US 6,939,439 B1
(45) Date of Patent: Sep. 6, 2005

(54) BATCH PROCESS FOR PRODUCING CHEMICAL PULP BY REMOVING AND REINTRODUCING CALCIUM-CONTAINING SPENT LIQUOR IN THE DIGESTER

(75) Inventors: Asko Paakki, Lappeenranta (FI); Päivi Uusitalo, Noormarkku (FI); Mikael Svedman, Pori (DE)

(73) Assignee: Metso Chemical Pulping Oy, (FI)

( * ) Notice: Subject to any disclaimer, the term of this patent is extended or adjusted under 35 U.S.C. 154(b) by 291 days.

(21) Appl. No.: 10/089,022

(22) PCT Filed: Oct. 4, 2000

(86) PCT No.: PCT/FI00/00855

§ 371 (c)(1),
(2), (4) Date: Mar. 25, 2002

(87) PCT Pub. No.: WO01/25531

PCT Pub. Date: Apr. 12, 2001

(30) Foreign Application Priority Data

Oct. 4, 1999 (FI) ..... 19992132

(51) Int. Cl.[7] ..... D21C 3/22; D21C 11/00

(52) U.S. Cl. ..... 162/40; 162/47; 162/48; 162/49; 162/52

(58) Field of Search ..... 162/19, 40, 47, 162/52, 237, 246, 248, 250, 48, 49, 61, 62

(56) References Cited

U.S. PATENT DOCUMENTS

| | | | | |
|---|---|---|---|---|
| 4,071,399 | A * | 1/1978 | Prough | 162/16 |
| 4,689,117 | A * | 8/1987 | Villavicencio | 162/19 |
| 4,764,251 | A | 8/1988 | Ostman | |
| 4,814,042 | A | 3/1989 | MacLeod et al. | |
| 5,183,535 | A | 2/1993 | Tikka | |
| 5,578,149 | A | 11/1996 | De Scheerder et al. | |
| 5,643,410 | A | 7/1997 | Hiljanen et al. | |
| 6,090,240 | A * | 7/2000 | Eneberg et al. | 159/47.3 |
| 6,438,390 | B1 * | 8/2002 | Awan | 162/19 |

FOREIGN PATENT DOCUMENTS

| | | |
|---|---|---|
| EP | 0 313 730 A1 | 5/1989 |
| WO | 99/02771 A1 | 1/1999 |
| WO | 00/11263 A1 | 3/2000 |

OTHER PUBLICATIONS

Thomas Grace, "Evaporator Scaling", Southern Pulp and Paper Manufacturer, vol. 8, pp. 46-23 (Aug. 1977).

Tappi 1998 International Chemical Recovery Conference Proceedings, Tampa, Fl., USA, Jun. 1-4, 1998, vol. 1, p. 379-383, (1998).

* cited by examiner

*Primary Examiner*—Steve Alvo
(74) *Attorney, Agent, or Firm*—Lerner, David, Littenberg, Krumholz & Mentlik, LLP

(57) ABSTRACT

Methods for producing chemical pulp from lignocellulose-containing material in processes for kraft pulp production are disclosed including charging the lignocellulose-containing material to a digester, initially treating the lignocellulose-containing material with an impregnation liquor, and then treating the impregnated lignocellulose-containing material with hot liquor and displacing calcium-containing spent liquor from the digester during that treatment, heating and cooking the heated lignocellulose-containing material to produce cooked lignocellulose-containing material and cooking liquor and displacing the cooking liquor from the digester using at least a portion of the displaced calcium-containing spent liquor.

9 Claims, 1 Drawing Sheet

BATCH PROCESS FOR PRODUCING CHEMICAL PULP BY REMOVING AND REINTRODUCING CALCIUM-CONTAINING SPENT LIQUOR IN THE DIGESTER

FIELD OF THE INVENTION

The present invention relates to improvements in kraft cooking processes. More particularly, the present invention relates to improvements in batch processes for kraft pulp production in which fouling of heat transfer surfaces is reduced.

BACKGROUND OF THE INVENTION

In the kraft cooking process, cellulosic material, most conveniently in the form of chips, is treated at elevated temperatures, typically from about 160° C. to 180° C., with alkaline cooking liquor containing sodium hydroxide and sodium sulfide. The fresh inorganic liquor is referred to as white liquor, and the spent liquor containing the dissolved wood material is referred to as black liquor.

Since the emergence of such kraft cooking processes, and to the present date, one of the most important objectives has been the attempt to reduce the energy consumption of the cooking process. Processes have therefore been developed for the purpose of, among other aspects, energy saving. In continuous processes, this may take place by heating the chip material with secondary steam which is obtained from flashing the hot black liquor. In batch cooking processes, the most useful technique is to recover the hot black liquor at the end of the cooking stage, and to reuse its energy 1) as a direct heating medium to be pumped into the digester during a subsequent batch, and 2) to heat up white liquor by means of heat exchangers. Good examples of these developments are batch processes described in, e.g. Fagerlund, U.S. Pat. No. 4,578,149 and Östman, U.S. Pat. No. 4,764,251. The displaced liquors of over 10° C. are stored in one or more pressurized accumulators which further contain a continuous heat recovery system (see, e.g. U.S. Pat. No. 5,643,410). As a result, the energy efficiency of batch cooking has increased.

Another important objective has been to improve the properties and quality of the pulp produced by these processes. In the liquor displacement batch method, avoiding digester discharge by means of hard hot blow techniques has made this possible. Gentle digester discharge is typically accomplished by cooling the digester prior to discharge, relieving the overpressure in the digester and then pumping the cooked material from the digester (see, e.g., U.S. Pat. No. 4,814,042). Further development of liquor-displacement kraft batch cooking has also involved the combination of energy efficiency and efficient usage of residual and fresh cooking chemicals to facilitate delignification and high pulp strength (see, e.g., U.S. Pat. No. 5,183,535 and U.S. Pat. No. 5,643,410). This can be accomplished by arranging the displacement at the end of the cook to first recover the "mother" black liquor, which is hot and rich in residual sulfur, into one accumulator, and then to recover the portion of black liquor contaminated by wash filtrate and lower in solids and temperature in another accumulator. The accumulated black liquors are then reused in reverse order to both impregnate and react with the next batch of wood chips prior to finalization of the cook with white liquor. Thus, it has become possible to start a kraft cook with a high charge of sulfur and a low charge of alkali and carry out important sulfur-lignin reactions in the early phase, especially in the hot black liquor treatment, facilitating subsequent delignification with fresh cooking liquor.

The above-mentioned development of the batch cooking technology has thus been characterized by improvements in terms of energy savings and properties of the delignified cellulosic material such as strength and uniformity.

Also important in the cooking process is that the process have a good fit to surrounding processes as e.g. spent liquor evaporation and pulp washing. Through black liquor evaporation, incineration, melting of the smelt into a water solution and causticizing the resulting liquor, white liquor is regenerated from the chemicals contained in the black liquor. This is the basis for recovery of alkaline spent liquors.

Traditionally, both in the case of batch cooking processes and continuously operated cooking processes, the black liquor led to evaporation originates from the main cooking stage at elevated temperature. In the search for improved energy efficiency and improved properties of the delignified cellulosic material, cooking methods have been developed in which the black liquor fed to the evaporation plant is recycled black liquor originating from the early stages of the cooking sequence. Such processes have been disclosed in e.g., U.S. Pat. No. 5,643,410.

It has been observed that the properties of the black liquor originating from the early stages of the cook differ from those of black liquor from a traditional cook. Recycled black liquor originating from the early stages of the cooking sequence may complicate the evaporation of black liquor. A particular problem is fouling of the surfaces of heat exchangers in the evaporation plant, leading to a decrease in heat transfer. Fouling may be so extensive that the heat transfer surfaces must be repeatedly cleaned, which requires special procedures, calls for an evaporation plant shutdown, and may even limit production. The evaporator fouling problems with black liquors that originates from the early stages of cooking are typically related to calcium.

In the early stage of alkaline cooking, calcium-containing material dissolves into the black liquor from the lignocellulosic material. In a traditional cook, the cook proceeds by heating, the temperature increases and no essential liquor exchange occurs. Then, a major part of the dissolved calcium-containing material in the cooking liquor is broken down, calcium carbonate is formed, and as a result a major part of the calcium is resorbed onto the lignocellulosic material in the digester. Typically, following such a cooking process, evaporation of the black liquor can be carried out without problems caused by precipitation of calcium on the heat transfer surfaces, as the black liquor fed to evaporation originates from the cooking stage at elevated temperatures.

The evaporation problems with black liquors originating from the early stages of cooking typically relate to such calcium-containing material being dissolved in the early stages of a cook. The dissolved calcium-containing material has not been degraded, and the amount of calcium bound to the dissolved material in the black liquor is high. In subsequent evaporation processes, the solids content of the black liquor rises and the evaporation temperature typically increases. Thus, the dissolved material is degraded further as evaporation proceeds and the solids content and temperature both rise. The calcium bound to the dissolved material in the black liquor is thereby set free. The liberated calcium reacts with the carbonate in the black liquor, forming calcium carbonate. A significant amount of crystallization occurs on the evaporation plant's heat transfer surfaces, whereby the plant's water evaporation capacity is severely limited. Crystallization may be so extensive that the heat transfer surfaces must be repeatedly cleaned.

It has been shown that a liquor's potential for calcium carbonate precipitation is dependent on the temperature history of the liquor. Fredrick and Grace (Southern Pulp and Paper Manufacturer 42 (1979) 8:16–23) have proposed that the amount of dissolved calcium is increased because in the black liquor the calcium forms a complex with the lignin. This complex is unstable at higher temperatures. At higher temperatures, the complex breaks down, and if calcium ions are released close to a hot surface, the calcium ion reacts with carbonate ions present in the liquor, and the precipitate is formed on the surface.

Frederick and Grace have proposed that calcium precipitation can be decreased or avoided by heating the black liquor between evaporation stages to temperatures of between about 150° C. to 160° C. and times of from about 10 to 20 minutes. However, the above mentioned method has not been extensively in use because it raises investment and operating costs.

Magnusson, Sjölander and Liden have suggested, that the existence of dissolved calcium in kraft black liquors can be explained by the high amounts of dissolved carbon present (Tappi 1998 International Chemical Recovery Conference Proceedings, Tampa, Fla., USA, 1–4 Jun. 1998, Vol. 1, p. 379–383). The introduction of dissolved forms of calcium into the black liquor will lead to an increased degree of supersaturation. Since this form of calcium is thermodynamically unstable with respect to calcium carbonate formation, heating of such liquors will, at some elevated temperatures, cause rapid precipitation. These authors have shown that calcium carbonate precipitation occurs in the temperature range of from about 110° C. to 145° C., and they have also suggested that potential danger of scaling problems in evaporation plants could be avoided by heat treatment that triggers calcium carbonate precipitation during a process stage where it does not lead to harmful scaling.

Others have proposed direct heating of black liquors fed to the evaporator at a temperature of from about 110° C. to 145° C. and times of from about 1 to 20 minutes (patent application FI 980387). However, this method also increases the investment costs.

SUMMARY OF THE INVENTION

In accordance with the present invention, these and other objects have now been realized by the discovery of a method for producing chemical pulp from lignocellulose-containing material by means of alkaline cooking, comprising the steps of (a) charging the lignocellulose-containing material to a digester; (b) initially treating the lignocellulose-containing material with an impregnation liquor to produce an impregnated lignocellulose-containing material; (c) treating the impregnated lignocellulose-containing material with hot liquor so as to produce a heated lignocellulose-containing material, and displacing calcium-containing spent liquor from the digester during the treatment; (d) heating and cooking the heated lignocellulose-containing material at predetermined cooking temperatures and pressures so as to produce cooked lignocellulose-containing material and cooking liquor; and (e) displacing the cooking liquor from the digester using at least a portion of the displaced calcium-containing spent liquor. Preferably, the method includes collecting the displaced calcium-containing spent liquor from the digester in a first portion having a first calcium content and at least one second portion having a second calcium content, the at least one second portion having a lower calcium content, on a dry solids basis, than the first portion. In a preferred embodiment, the method includes combining the at least one second portion of the calcium-containing spent liquor with a portion of the displaced cooking liquor to produce a combined liquor, and supplying the combined liquor to a subsequent batch of the lignocellulose-containing material to supply heat thereto.

In accordance with one embodiment of the method of the present invention, the method includes displacing the cooking liquor from the digester using the first portion of the displaced calcium-containing spent liquor. Preferably, the displacing of the cooking liquor from the digester using the first portion of the displaced calcium-containing spent liquor comprises the first portion of liquor introduced into the digester for displacing the cooking liquor therefrom.

In accordance with another embodiment of the method of the present invention, the method includes displacing the cooking liquor from the digester using the at least one second portion of the calcium-containing spent liquor.

In accordance with another embodiment of the method of the present invention, the method includes monitoring the calcium content, on a dry solids basis, of the calcium-containing spent liquor during its displacement.

In accordance with another embodiment of the method of the present invention, the method includes monitoring the temperature of the calcium-containing spent liquor during its displacement.

In accordance with the present invention, these and other objects has now been accomplished by the discovery of a new method for preparing pulp. More particularly, the present invention relates to processes for preparing pulp in which cellulosic material is treated in one or several impregnation and pretreatment stages before delignifying the heated cellulosic material with fresh alkaline cooking liquor at elevated temperatures. The present invention specifically relates to the liquor exchange in a cooking process that produces high quality pulp, is energy efficient and generates spent liquor, which liquor can be processed in the evaporation plant without forming scaling of low solubility.

For the purpose of this specification, "calcium-containing spent liquor" refers to a process liquor containing calcium bound to dissolved organic material. The calcium content is calculated on the basis of calcium in the dry solids content of the liquor.

In accordance with the present invention, a process is provided for the preparation of pulp from lignin-containing cellulosic material using alkaline cooking, which process comprises the stages of a) charging lignocellulose-containing material to a digester, b) treating the lignocellulose-containing material initially with an impregnation liquor, and subsequently with hotter liquors, and displacing calcium-containing spent liquor from the digester, c) heating and cooking the lignocellulose-containing material at cooking temperatures and pressures to produce cooked lignocellulose-containing material and cooking liquor, and d) displacing the cooking liquor using at least part of the calcium-containing spent liquor, whereby the calcium-containing spent liquor is heated by the digester contents.

Preferably, stage b) includes the sequential introduction of impregnation liquor, hot black liquor and preheated white liquor in proper ratios. The last part of the final displacement stage in d) is preferably carried out using wash filtrate from the downstream process.

In accordance with one embodiment of the process of the present invention, the temperature of the impregnation liquor is between about 20° C. and 100° C., the temperatures of the hotter liquors are between about 120° C. and 180° C. and the temperature of displaced calcium-containing spent liquors are between about 20° C. and 160° C.

In accordance with one embodiment of the process of the present invention, the method includes monitoring the calcium content of spent liquor being displaced, in order to determine the proper cut points for isolating displaced calcium-containing spent liquor which may cause calcium precipitation at higher temperatures and/or dry solid contents.

In accordance with another embodiment of the process of the present invention, the method includes monitoring the temperature of spent liquor being displaced, in order to determine the proper cut points for isolating displaced calcium-containing spent liquor.

In accordance with another embodiment of the process of the present invention, the temperature of displaced calcium-containing spent liquor is between about 20° C. and 100° C.

In accordance with another embodiment of the present invention, a process using alkaline cooking is provided for the preparation of pulp from lignin-containing cellulosic material, which process comprises a) charging lignocellulose-containing material to a digester; b) treating the lignocellulose-containing material initially with an impregnation liquor and subsequently with hotter liquors, displacing from the digester during the subsequent treatments a first portion of calcium-containing spent liquor, and at least a second portion of calcium-containing spent liquor at lower calcium content compared to the first portion of calcium-containing spent liquor, c) heating and cooking the lignocellulose-containing material to produce cooked lignocellulose-containing material and cooking liquor, d) displacing the cooking liquor initially with the first portion of calcium-containing spent liquor, whereby the calcium-containing spent liquor is heated by the digester contents, and subsequently with wash filtrate so as to displace spent liquor and cool the digester content; and e) discharging the digester.

In accordance with another embodiment of the present invention, several portions of calcium-containing spent liquor containing different amounts of calcium are used for displacement of cooking liquor, sequentially or in combination with wash filtrate.

In accordance with the present invention, a process using alkaline cooking is provided for the preparation of pulp from lignin-containing cellulosic material, the process comprising the steps of a) charging lignocellulose-containing material to a digester; b) treating the lignocellulose-containing material initially with an impregnation liquor and subsequently with hotter liquors, thereby displacing from the digester a first portion of calcium-containing spent liquor and a second portion of calcium-containing spent liquor having a lower calcium content compared to the first portion of calcium-containing spent liquor; c) heating and cooking the lignocellulose-containing material to produce cooked lignocellulose-containing material and cooking liquor; d) displacing the cooking liquor initially with a portion of the calcium-containing spent liquor, whereby the calcium-containing spent liquor is heated by the digester contents, and subsequently with wash filtrate so as to displace a first portion of cooking liquor, the first portion of cooking liquor having a temperature and dry solids content substantially corresponding to the temperature and dry solids content of the cooking liquor at the end of the cook; and to displace a second portion of cooking liquor, the second portion of cooking liquor having a temperature and dry solids content substantially lower than the temperature and dry solids content of the cooking liquor at the end of the cook; maintaining the first and second portion of cooking liquor separate from each other; combining the second portion of calcium-containing liquor and the second portion of cooking liquor; utilizing the first portion of cooking liquor for pretreating and heating the lignocellulosic material of a subsequent batch; and using the combined second portion of calcium-containing liquor and second portion of cooking liquor for supplying heat to a subsequent batch of lignocellulose-containing material.

In a preferred embodiment of the present invention, the method includes transferring the combined second portion of calcium-containing liquor and second portion of cooking liquor, after supplying heat to the subsequent batch of lignocellulose-containing material, to a liquor tank at atmospheric pressure. Preferably, the method includes separating and removing soap contained in the combined portions of liquor.

In a preferred embodiment of this method of the present invention, the method includes transferring the combined second portion of calcium-containing liquor and second portion of cooking liquor, after supplying heat to a subsequent batch of lignocellulose-containing material, to an evaporation plant for recovery of cooking chemicals.

In accordance with one embodiment of this method of the present invention, the method includes utilizing wash filtrate and a combined second portion of calcium-containing liquor and second portion of cooking liquor and for impregnating the lignocellulose-containing material in an impregnation step.

In a preferred embodiment, the wash filtrate comprises a filtrate from a subsequent wash plant for kraft pulp.

In accordance with another embodiment of this method of the present invention, the method includes utilizing the combined second portion of calcium-containing liquor and second portion of cooking liquor for preheating fresh alkaline cooking liquor supplied to the digester.

As calcium-containing spent liquor is fed into the digester following the cooking stage, when the cooking liquor at cooking temperature is displaced, the calcium-containing material extracted in the early stages of the process decomposes when the calcium-containing liquor enters the hot digester. Thus, the calcium bound to dissolved material is set free in the digester because of the high temperature. The liberated calcium reacts with carbonate ion, and calcium carbonate is formed in the digester where no scaling can be formed on heat transfer surfaces. Thus, the formed calcium carbonate is retained in the pulp and is not extensively carried to the evaporating plant.

In general, the present invention provides a method for overcoming a drawback in prior art low energy kraft batch cooking processes. In the process according to the present invention, kraft pulp is prepared and spent liquor is generated which, when fed to an evaporation plant, can be processed without forming scaling of low solubility. An essential advantage is that the method does not require any essential investments and has no impact on sequence times and production capacity.

BRIEF DESCRIPTION OF THE FIGURE

The present invention may be more fully appreciated with reference to the following detailed description which, in turn, refers to the FIGURE, which is a schematic representation of a liquor displacement kraft batch process according to the present invention.

DETAILED DESCRIPTION

Figure 1:
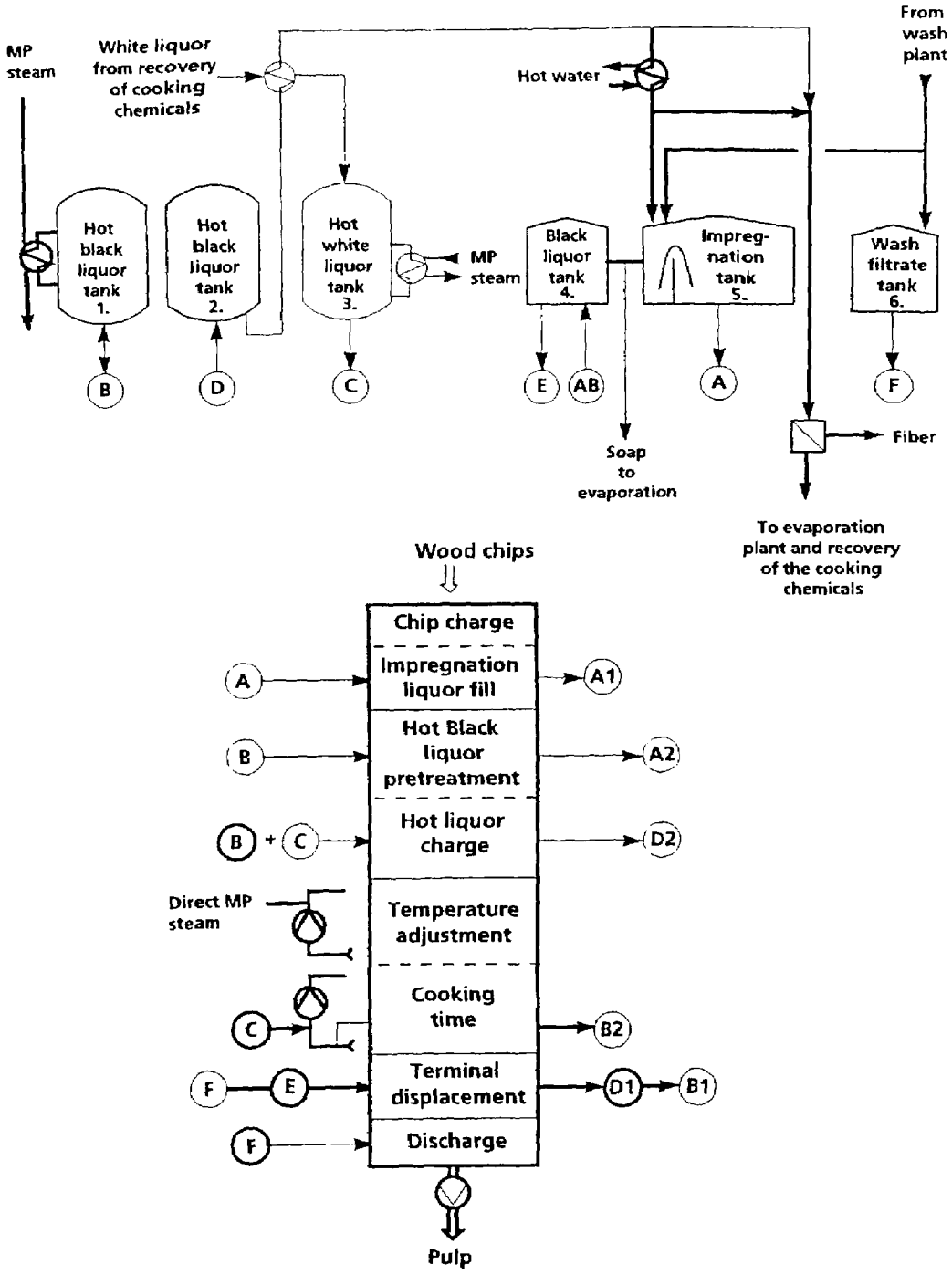

FIG. 1 shows a block diagram of a liquor-displacement kraft batch process according to the present invention. The FIGURE defines the required tanks, streams and the cooking sequence. Charging the digester with wood chips and evacuating the digester starts the kraft cook. The chips can be packed with steam or be pre-steamed, before the digester is filled essentially with impregnation liquor A from the impregnation liquor tank 5, soaking and heating the chips. Wood chip charging and impregnation liquor charging preferably overlap. An overflow, A1, to black liquor tank, point AB, is carried out in order to remove air and diluted first front of liquor. Preferably, the volume of A1 is kept low. After closing the flow, the digester is pressurized and impregnation is completed. During impregnation, a relatively low temperature is preferred, since a higher impregnation temperature will consume residual alkali too fast, resulting in higher rejects and non-uniform cooking. Preferably, the temperature of this impregnation step is below about 100° C. In practice, temperatures of from about 20° C. to 100° C. can be utilized.

In the next stage, the wood chips are further treated with hotter liquors before actual cooking. The temperatures of the hotter liquors are between about 120° C. to 180° C. In FIG. 1, a method is described where hot black liquor B is pumped in from hot black liquor tank 1. Black liquor from tank 1 is at constant temperature, dry solids content and residual alkali, which makes it easy to maintain conformity from cook to cook. This is extremely important because the hot black liquor has a major chemical effect on the wood, and controls the selectivity and cooking kinetics in the main cooking phase with white liquor. The cooler and partly diluted impregnation liquor A2, displaced by hot black liquor, is essentially conducted to black liquor tank 4, point AB. In the spent liquor portions A1 and A2, the dissolved material typically has the highest content of calcium. The cooking sequence is continued by pumping in hot white liquor, point C, from the hot white liquor tank 3 and a smaller amount of hot black liquor, B, 1) simultaneously with the hot white liquor, in order to dilute the very high alkali concentration of fresh white liquor and 2) after white liquor charge, in order to flush lines into the digester. The liquor D2, displaced by hot liquor, preferably above about the atmospheric boiling point, is conducted to hot black liquor tank 2.

According to the prior art as disclosed in e.g. U.S. Pat. No. 5,643,410, the displaced liquors A1 and A2 are essentially conducted to the evaporation plant. This procedure will, however, transfer the calcium-containing dissolved material, which has not yet been degraded in the cooking process, to the evaporation plant. In the subsequent evaporation process, during which the solids content and temperature typically increase, the calcium bound to the dissolved material in the black liquor is set free. As a consequence, calcium carbonate scaling occurs on heat transfer surfaces of evaporation units, whereby the plant's evaporation capacity is severely impaired.

According to the present invention, tank 4 is used for storing the spent cooking liquor portions containing released calcium-containing material from the early impregnation and pretreatment stages of the cooking sequence, which liquors tend to form calcium precipitates at higher temperatures and dry solid contents. Preferably, the portion at the highest concentration of calcium is stored in tank 4. Most preferably, tank 4 is an atmospheric tank. The exact volume to be recovered to tank 4 is most suitably controlled by monitoring the calcium content, dry solids concentration and temperature of the displaced liquor exiting from the digester. After detecting a clear drop in calcium content bound to the dissolved material, the displaced liquor is switched to enter black liquor tank 2. The switch preferably occurs before the atmospheric boiling point of the displaced liquor is exceeded.

Further division of the calcium-containing displaced liquor is also possible, depending on available tank capacity. Preferably, the fractions are then used for final displacement in the same order, as described below.

After the filling procedure described above, the digester temperature is close to the final cooking temperature. The final cooking temperature can be between about 140° C. to 180° C., depending on the wood raw material. The final heating-up is carried out using direct or indirect steam heating and digester re-circulation. During cooking, additional fresh cooking liquor, C, from tank 3 can be added to even out the alkali profile. Spent liquor, B2, is then removed from the digester to tank 1 or tank 2.

After the desired cooking time, when delignification has proceeded to the desired degree of reaction, the now spent cooking liquor is ready to be displaced with cool liquor, which serves to stop the cooking reactions and to cool and wash the digester content. According to the present invention, the cooking liquor is at least partly displaced with a liquor portion E from the black liquor tank 4. Preferably, portion E is initially introduced followed by washing filtrate, point F, from the wash filtrate tank 6. In this manner, the calcium-containing liquors generated in the early stages of the process, i.e. portion E from tank 4, which contains the highest amount of calcium bound to dissolved material, and is most liable to cause scaling precipitates in evaporation according to prior art methods, is introduced in the digester as the digester contents are at a high initial temperature. Consequently, the dissolved material decomposes and calcium carbonate is formed mainly within the bulk of the liquor, and remains in the liquor as calcium carbonate crystals, or is absorbed into the pulp. In this manner, the spent liquor conducted to the evaporation plant from the cooking process is essentially free of problematic calcium bound to dissolved material.

If further subdivision of the calcium-containing liquors displaced from the digester has taken place, the fractions may be used in the same order for the final displacement, the latter fractions of successively lower calcium content experiencing successively lower temperatures.

No prior art technology using the impregnation and pretreatment procedures described above is able to produce spent liquor for the evaporation plant without calcium carbonate-related problems. The black liquor tank 4 now has a new role in the cooking process. It first collects the most problematic calcium-containing spent liquors and then transfers these liquors to the terminal displacement of the hot cooking liquor, preferably to the initial stages of the terminal displacement.

The present invention will not essentially affect the washing efficiency of the terminal displacement, since the portion E contains chip water and some diluted spent liquor. Thus, the dissolved solids content of portion E is in the same order as that of the washing filtrate F. The cooling efficiency of the terminal displacement will be improved since the portion E has a low temperature, preferably about 20° C. to 100° C.

In the terminal displacement step, the first portion B1 of exiting hot black liquor corresponds to the total of the volumes B required in the filling stages. Preferably, the terminal displacement is carried out to produce a displaced portion of spent cooking liquor having a temperature and dry solids content substantially corresponding to the predetermined temperature and dry solids content of the cooking liquor. The second portion D1 of displaced spent cooking liquor, which is diluted by the displacement filtrate but is still above its atmospheric boiling point, is conducted to the hot black liquor tank 2. After completed final displacement, the digester contents are discharged for further processing of the pulp. The above cooking sequence may then be repeated.

The equipment for the cooking process includes the tank farm, where fresh liquors and spent liquors are stored and heat is recovered. The impregnation liquor tank is provided with wash liquor from the washing plant. The hot black liquor tank 2 provides spent black liquor to the evaporation plant through fiber separation, and also partly provides cooled impregnation black liquor to the impregnation liquor tank, transferring heat to white liquor and water by means of heat exchange. The spent liquor transferred to the evaporation plant, according to the present invention, thus originates from conditions at higher temperatures compared to prior art technology, such as that described in U.S. Pat. No. 5,643,410. According to the present invention, tank 2 also has a function of decomposing calcium-containing dissolved material, as tank 2 provides residence times of from about 10 to 60 minutes and temperatures from about 100° C. to 135° C. The temperature of tank 2 depends, among other factors, on the arrangement of terminal displacement, temperature of charged lignocellulosic material, and the switching point from collecting to tank 4 to tank 2 in the pretreatment step. An additional advantage of the present invention compared to prior art such as the process of U.S. Pat. No. 5,643,410, is that the temperature of the spent liquor conducted to the evaporation plant can be controlled. This is especially important when outside temperatures are low, e.g. during winter when temperatures in the lignocellulosic material charged to the cooking system is below the freezing point of water. In prior art processes, the temperature of the evaporation liquor has dropped in winter conditions, causing control difficulties and increased heating requirements in the evaporation plant. Another advantage of the present invention is that the fiber separation of the spent liquor conducted to the evaporation plant can occur at higher temperatures, facilitating soap solubility and reducing carryover of soap to the separated fiber fraction. The soap is preferably conducted with the spent liquor to the evaporation plant, where soap can be further removed.

Tanks 4, 5 and 6 are furnished with soap separation equipment according to prior art soap separation technology. Practical experience on mill-scale has proven that soap removal in these locations of the black liquor transfer sequence is of major importance, especially when processing soap-containing softwood raw materials. It is of great importance to use only low-in-soap black liquor for impregnation or other digester filling purposes.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A batch process for producing chemical pulp from lignocellulose-containing material by means of alkaline cooking, comprising the steps of:

a) charging said lignocellulose-containing material to a digester;

b) initially treating said lignocellulose-containing material with an impregnation liquor to produce an impregnated lignocellulose-containing material;

c) treating said impregnated lignocellulose-containing material with hot liquor so as to produce a heated lignocellulose-containing material, displacing calcium-containing spent liquor from said digester during said treatment; removing said calcium containing spent liquor from said digester; and storing said calcium-containing spent liquor in a storage unit;

d) allowing said lignocellulose-containing material to continue being treated while said calcium-containing spent liquor is stored in said storage unit;

e) heating and cooking said heated lignocellulose-containing material at predetermined cooking temperatures and pressures so as to produce cooked lignocellulose-containing material and cooking liquor; and f) reintroducing said calcium-containing spent liquor in said storage unit back into said digester so as to displace said cooking liquor from said digester using at least a portion of said displaced calcium-containing spent liquor being reintroduced into said digester.

2. The method according to claim 1, including collecting said displaced calcium-containing spent liquor from said digester in a first portion having a first calcium content and at least one second portion having a second calcium content, said at least one second portion having a lower calcium content, on a dry solids basis, than said first portion.

3. The method according to claim 2, including combining said at least one second portion of said calcium-containing spent liquor with a portion of said displaced cooking liquor to produce a combined liquor, and supplying said combined liquor to a subsequent batch of said lignocellulose-containing material to supply heat thereto.

4. The method according to claim 2, including displacing said cooking liquor from said digester using said first portion of said displaced calcium-containing spent liquor.

5. The method according to claim 4, wherein said displacing of said cooking liquor from said digester using said first portion of said displaced calcium-containing spent liquor comprises the first portion of liquor introduced into said digester for displacing said cooking liquor therefrom.

6. The method according to claim 2, including displacing said cooking liquor from said digester using said at least one second portion of said calcium-containing spent liquor.

7. The method according to claim 1, including monitoring the calcium content, on a dry solids basis, of said calcium-containing spent liquor during its displacement.

8. The method according to claim 1, including monitoring the temperature of said calcium-containing spent liquor during its displacement.

9. The method according to claim 1, further including monitoring a calcium content of said calcium-containing spent liquor in said storage unit and controlling a flow of said calcium-containing spent liquor based on said calcium content.

* * * * *

UNITED STATES PATENT AND TRADEMARK OFFICE

CERTIFICATE OF CORRECTION

PATENT NO. : 6,939,439 B1 
DATED : September 6, 2005
INVENTOR(S) : Asko Paakki, Päivi Uusitalo and Mikael Svedman It is certified that error appears in the above-identified patent and that said Letters Patent is hereby corrected as shown below:

Title page,
Item [75], Inventors, "Mikael Svedman, Pori (DE)" should read -- Mikael Svedman, Pori (FI) --.

Column 1,
Line 38, "10°" should read -- 100° --.

Signed and Sealed this

Twenty-first Day of March, 2006

JON W. DUDAS
*Director of the United States Patent and Trademark Office*